United States Patent [19]

Nicol et al.

[11] 4,000,093

[45] Dec. 28, 1976

[54] ALKYL SULFATE DETERGENT COMPOSITIONS

[75] Inventors: Charles Henry Nicol, Hamilton; Michael Eugene Burns, Fairfield, both of Ohio

[73] Assignee: The Procter & Gamble Company, Cincinnati, Ohio

[22] Filed: Apr. 2, 1975

[21] Appl. No.: 560,764

[52] U.S. Cl. ..... 252/529; 252/531; 252/550; 252/DIG. 2; 252/DIG. 15

[51] Int. Cl.[2] ..... C11D 3/22; C11D 1/14

[58] Field of Search ..... 252/531, 550, DIG. 15, 252/DIG. 2, 529

[56] References Cited

UNITED STATES PATENTS

| | | | |
|---|---|---|---|
| 2,716,072 | 8/1955 | Hanson | 252/550 X |
| 3,061,551 | 10/1962 | Rutenberg et al. | 252/550 X |
| 3,779,929 | 12/1973 | Abler et al. | 252/550 X |

FOREIGN PATENTS OR APPLICATIONS

| | | | |
|---|---|---|---|
| 402,787 | 8/1968 | Australia | 252/550 |
| 588,653 | 5/1947 | United Kingdom | 252/550 |
| 645,752 | 11/1950 | United Kingdom | 252/550 |
| 646,434 | 11/1950 | United Kingdom | 252/550 |

*Primary Examiner*—Harris A. Pitlick
*Attorney, Agent, or Firm*—Charles R. Wilson; Jerry J. Yetter; Richard C. Witte

[57] ABSTRACT

Cellulose-based soil release ethers are used in detergent compositions containing $C_{10}$–$C_{13}$ alkyl sulfate surfactants, and substantially free from interfering amounts of longer-chain length alkyl sulfates, to provide optimal soil release performance.

26 Claims, 1 Drawing Figure

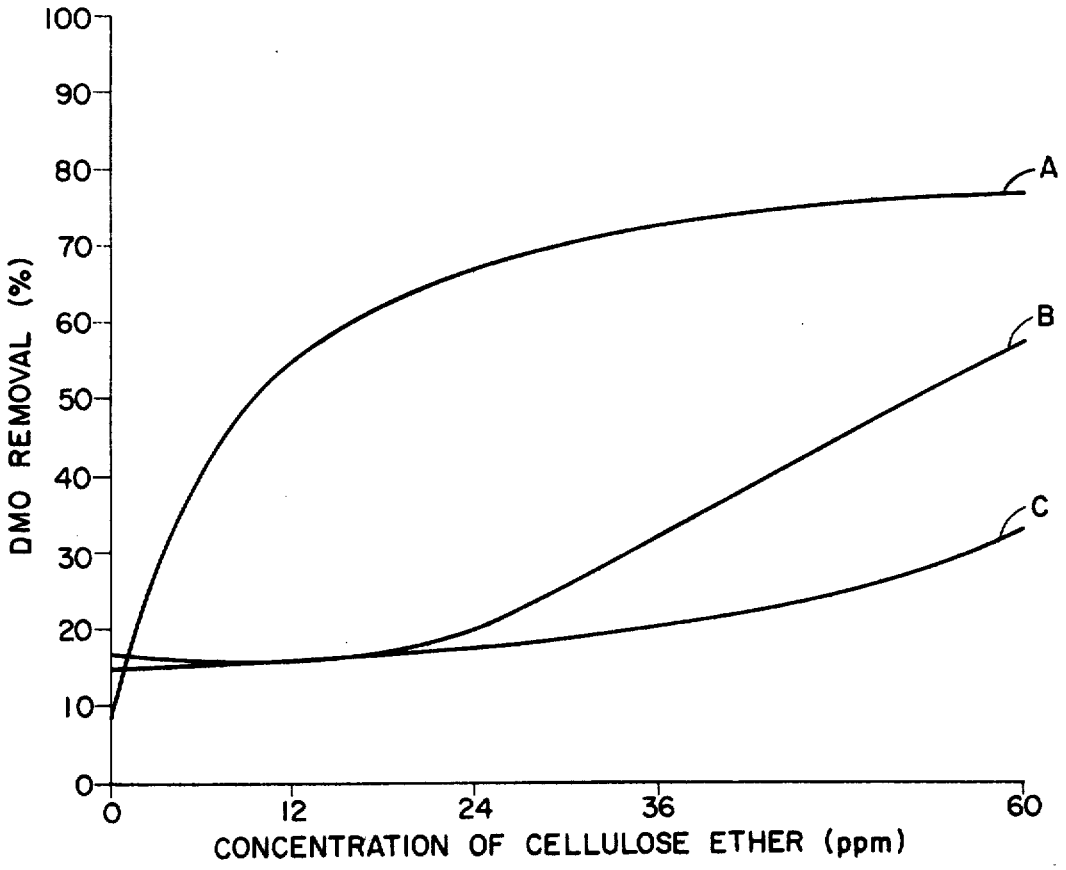
100
90
80
70
60
50
40
30
20
10
0
DMO REMOVAL (%)
A
B
C
0
12
24
36
60
CONCENTRATION OF CELLULOSE ETHER (ppm)

ALKYL SULFATE DETERGENT COMPOSITIONS

BACKGROUND OF THE INVENTION

This invention relates to detergent compositions containing cellulose-based soil release ethers. More particularly, the compositions herein are formulated from optimal, narrow "cuts" of alkyl sulfate surfactants which do not substantially interfere with the soil release performance of the cellulose ethers.

As noted hereinafter, much effort has been expended in designing various compounds which are capable of conferring soil release properties to fabrics during a home laundering operation. The extensive work in this area has, in the main, been directed toward using various polymers as detergent additives with the goal of depositing such polymers onto cotton, polyester and polyester/cotton fabrics from an aqueous laundry bath to secure a soil release benefit in subsequent launderings.

For the most part, the literature relating to soil release polymers indicates that efforts to improve the efficacy of detergent compositions containing such materials as additives has focused on the nature of the polymers themselves, and a great variety of such polymers have been prepared and tested.

The continuing search for detergent compositions containing truly effective soil release additives reflects the recognition that many such materials are not particularly useful in this regard, other than at high concentrations. Of course, the use of high concentrations of any additive in detergent compositions is an economic waste if lower amounts would suffice. Moreover, such additives are preferably degraded before being released into water supplies. While many of the prior art soil release materials are entirely acceptable from a toxicological standpoint, their presence in sewage effluents in high concentrations results in an increased biological oxygen demand, with a decrease in water quality. Accordingly, it would be useful to provide detergent compositions containing small, yet effective, amounts of soil release additives.

The most attractive type of soil release polymers are those based on cellulose as a raw material. The cellulose ethers are one such type of polymer. The cellulose ethers are simple to prepare, biodegradable, and are quite acceptable from a toxicological standpoint. Indeed, many such materials are known for use as food additives.

Various cellulose ether soil release polymers are known in the art, and many such materials have been suggested for use both in laundry baths in combination with surfactants and in rinse baths in the absence of surfactants. Clearly, from the standpoint of ease-to-use, it is more convenient to apply the soil release polymers to fabrics in conjunction with a laundering operation.

It has now been discovered that, contrary to the teachings of the prior art, the selection of surfactant for use in combination with cellulose ethers has a substantial effect on their soil release properties. Many detersive surfactants interact with the cellulosics and substantially decrease their efficacy as soil release agents. Accordingly, the formulators of detergent compositions containing such materials have been constrained either to accept a sub-optimal level of performance, or to use unduly high concentrations of the cellulose ether polymers in detergent compositions to achieve good soil release performance.

It has further been discovered that certain alkyl sulfate surfactants are particularly useful for preparing detergent compositions which impart superior soil release properties to fabrics in the presence of but small quantities of cellulose ether soil release agents. It is especially advantageous that the alkyl sulfates of the type disclosed herein are useful in combination with cellulosics, inasmuch as this general type of surfactant is well-accepted by consumers.

Finally, it has now been discovered that certain fabric finishes, especially those used on polyester/cotton fabrics, have a substantial effect on the ability of cellulose ethers to provide optimal soil release performance benefits. The soil release ethers used in combination with the preferred surfactants herein can be selected from a wide range of cellulosics if unfinished polyester/cotton is being laundered. However, if durablepress finished polyesters, or mixed loads, are being laundered, it is more preferred to select certain cellulosics which are more robust, i.e., those which perform well on both polyesters and finished and unfinished polyester/cotton blends. The basis for selecting such preferred soil release ethers is disclosed hereinafter.

It is an object of the present invention to provide detergent compositions containing soil release additives.

It is another object of this invention to provide detergent compositions which exhibit optimal soil release performance with minimal concentrations of cellulose ether soil release additives.

These and other objects are obtained herein as will be seen from the following disclosure.

PRIOR ART

The following references relate to the use of cellulose ethers of various types in detergent compositions. The references reflect the fact that a wide variety of cellulosics, and mixtures thereof, have been suggested for use in detergent compositions. However, the criticality in surfactant selection does not appear to have been appreciated heretofore.

The use of methyl and ethyl cellulose ethers in detergent compositions is diclosed in U.S. Pat. No. 2,373,863, Vitalis, NONALKALINE DETERGENT COMPOSITION, Apr. 17, 1945. A great many cellulosics for use in detergents are disclosed in U.S. Pat. No. 2,994,665, Reich, et at., HEAVY DUTY LIQUID DETERGENT COMPOSITION CONTAINGING A PAIR OF CELLULOSIC SOIL SUSPENDING AGENTS, Aug. 1, 1961; see also U.S. Pat. No. 3,523,088, Dean, et al., NOVEL ANTIREDEPOSITION AGENT AND BUILT DETERGENT COMPOSITIONS CONTAINING SAID ANTIREDEPOSITION AGENT, Aug. 4, 1970. German Auslegeschrift No. 1,054,638, Van der Werth, Nov. 2, 1956, discloses $C_{12}$ alkyl benzene sulfonates in combination with carboxylated cellulose derivatives. British Pat. No. 1,084,061 discloses low amounts of cellulosics as stabilizers for liquid detergents. British Pat. Nos. 927,542; 765,811; and 340,232 also teach cellulosics in detergents. South African Pat. No. 71/5129, Foster, DETERGENT COMPOSITION, Jan. 1964, discloses detergent compositions containing hydroxyalkyl alkyl cellulosics. See also "Synthetic Detergents," McCutcheon (1950) pages 230 and 248.

The concurrently-filed application of Burns andd Nicol, entitled ALKYL BENZENE SULFONATE DETERGENT COMPOSITIONS, Ser. No. 560,766, relates to preferred alkyl benzene sulfonates and their use with cellulose soil release agents.

The concurrently-filed application of Nicol, entitled DETERGENT COMPOSITIONS, Ser. No. 560,769, relates to specified combinations of nonionic and anionic surfactants and their use as non-interfering detergents with cellulose soil release agents.

SUMMARY OF THE INVENTION

Various cellulose ethers can be dissolved in distilled water and applied to fabrics, especially polyesters, to provide substantial oily soil release benefits. For the most part, when such ethers are formulated in detergent compositions containing surfactants, builders, etc., the soil release performance of the ethers decreases markedly. It has now been found that the problem of the decrease in the inherently good soil release performance of cellulose ethers can be overcome.

The present invention is based on the discovery that certain alkyl sulfate surfactants have much less of an inhibitory effect on the soil release performance of cellulose-based ethers than do other alkyl sulfates. Accordingly, by proper selection of alkyl sulfate surfactants, it is now possible to provide detergent compositions having excellent through-the-wash soil release properties using substantially less cellulose soil release material than was heretofore thought possible.

Moreover, it has now been discovered that fabric finishes commonly used on polyester/cotton blend fabrics can substantially affect the soil release performance properties of cellulose soil release ethers. Accordingly, when formulating optimal compositions in the manner of this invention, it is highly preferred to select both a preferred alkyl sulfate surfactant and a preferred cellulosic, all as described more fully hereinafter.

Finally, it has been discovered that the removal of electrolytes (e.g., water-soluble builders) can further enhance the soil release performances of the surfactant/cellulose ether compositions herein. Highly preferred ziolite-built detergent compositions substantially free from water-soluble builders are described hereinafter.

The present invention encompasses detergent compositions, comprising:

a. from about 5% to about 50% by weight of a surfactant component consisting essentially of a water-soluble alkyl sulfate wherein the alkyl substituent has a chain length in the range of $C_{10}$–$C_{13}$, or mixtures thereof, said surfactant component optionally containing a detersive amount of water-soluble $C_{14}$ alkyl sulfate, said surfactant component being substantially free of $C_{15}$ and higher alkyl sulfates;

b. from about 0.1% to about 3% by weight of a soil release ether component selected from the group consisting of alkyl cellulose ethers, hydroxyalkyl cellulose ethers and hydroxyalky alkyl cellulose ethers;

c. from about 0% to about 70% by weight of a detergency builder component; and d. the balance of the composition comprising detergency adjunct materials and carriers.

When dealing with commercial surfactants, it is quite difficult to remove all interfering longer-chain materials. Accordingly, compositions having extremely high surfactant concentrations with extremely low soil release ether concentrations are preferably avoided. Compositions wherein the weight ratio of surfactant:cellulose ether is in the range of from 5:1 to 100:1, preferably 10:1 to 30:1, are most preferred herein and avoid "swamping" the cellulose ethers with interfering long-chain surfactants which might be present as impurities.

BRIEF DESCRIPTION OF THE DRAWINGS

The attached FIGURE is a graphical illustration of the data obtained in the Dirty Motor Oil Removal Test set forth hereinafter. Curve A relates to the test results obtained with $C_{12}$ alkyl sulfate. Curve B relates to the test results obtained with $C_{14}$ alkyl sulfate. Curve C relates to the test results obtained with $C_{15}$ alkyl sulfate. As extrapolated from the shape of the curves, and in accordance with the prior art, there is little difference in the performance properties of the surfactant/cellulose ether detergent compositions at extremely high concentrations of the ether. However, at low, useful concentrations of the cellulose ether, the unexpectedly superior soil release performance of the composition containing the $C_{12}$ alkyl sulfate is abundantly clear.

DETAILED DESCRIPTION OF THE INVENTION

The detergent compositions of the present invention comprise two essential components, the surfactant component and the cellulose ether soil release component, as described more fully hereinafter.

Surfactant Component

The surfactant employed herein is a water-soluble alkyl sulfate of the general formula $$R-O-SO_3M$$

wherein R is an alkyl (including unsaturated alkyl) substituent containing from about 10 to 13 carbon atoms, and wherein M is a cation selected to provide water-solubility of the alkyl sulfate, e.g., alkali metals, ammonium, alkanolammonium, and the like. Substituent R can be branched or straight chain, but is preferably straight chain, since such materials are biodegradable.

The gist of the present invention is the discovery that alkyl sulfate surfactants wherein substituent R is $C_{14}$, and higher, undesirably interact with the cellulosic soil release ethers. (As described hereinafter, some $C_{14}$ alkyl sulfate surfactant can desirably be present in the present compositions to boost overall detergency performance.) While not intending to be limited by theory, it appears that the interaction between the cellulosic and the longer chain alkyl sulfate surfactants interfere with deposition of the cellulosic on fibers and fabrics. Accordingly, when such longer chain surfactants are present in an aqueous laundry bath, a relatively high concentration of the cellulose material must be used to provide an excess over that which interacts with the surfactant.

The preparation of alkyl sulfate surfactants for use herein is not a part of the present invention. The $C_{10}$–$C_{13}$ alkyl sulfates can be conveniently prepared by fractionating alcohol feedstocks using standard distillation techniques to provide "light" fractions consisting essentially of the desired $C_{10}$–$C_{13}$ alcohol precursors. The light precursor alcohols can thereafter be reacted with $SO_3$ in standard fashion to provide the surfactants for use herein. The counterion, M, can be varied according to the desires of the formulator by neutralizing the acid form of the alkyl sulfate with the corresponding base. The counterion selected is not critical, other than it should be chosen to provide water solubility of the surfactant. Typical counterions include sodium, potassium, ammonium, triethanolammonium, and the like. The sodium alkyl sulfates are preferred from the standpoint of economy.

The surfactants herein are prepared in such fashion that they are "substantially free" of alkyl sulfates wherein group R is $C_{15}$, and higher. A minor amount of such longer chain sulfates can be present in the surfactant component, but is to be recognized that the presence of such materials will cause a corresponding decrease in the soil release effectiveness of the compositions. As can be seen from the FIGURE, it is desirable to provide laundering liquors containing from about 6 ppm to about 60 ppm of the cellulose ethers. Below the lower limit of this range, several washing cycles are needed to realize the performance advantages of the compositions. Beyond the upper limit of the range, excessive cost becomes a factor. Moreover, it is desirable for good fabric cleaning to use laundering liquors which have a surfactant:fabric weight ratio of about 0.005:1 to about 0.01:1. (For a standard, top-loading U.S. machine, this represents a concentration of ca. 200 ppm of the surfactant.) At high surfactant, low soil release ether concentrations, the amount of higher chain length sulfonates that can be tolerated while still achieving good soil release performance will be less than with compositions comprising a low-to-moderate concentration of surfactant and higher concentrations of soil release ether within the range. Accordingly, it is seen that the term "substantially free" is relative, and depends on the concentration of these two essential ingredients in the finished detergent compositions.

While the $C_{10}$, $C_{11}$, $C_{12}$ and $C_{13}$ alkyl sulfates are preferred herein by virtue of their compatibility with the cellulosics, superior overall detergency performance is provided by the $C_{14}$, and higher, alkyl sulfates. Accordingly, it is desirable that the surfactant component herein contain some of the $C_{14}$ compound, reecognizing that a "trade-off" between soil release and overall detergency performance will result. To maximize detergency performance while minimizing undesirable interactions with the soil release ethers, the compositions can contain a detersive amount of the $C_{14}$ alkyl sulfate at a weight ratio depending on the amount of cellulose ether, as noted above.

When preparing the detergent compositions of the present invention containing from about 0.1% to about 3% by weight of the soil release ether and from about 5% to about 50% by weight of the surfactant, it is preferred that the surfactant contain less than about 5% by weight of the $C_{15}$ and higher alkyl sulfates. The most highly preferred compositions herein comprise from about 0.5% to about 1.5% by weight of the soil release ether and from about 15% to about 25% by weight of the surfactant. The surfactant component in these highly preferred compositions comprises less than about 3% by weight of the $C_{15}$ and higher alkyl sulfates, but the overall composition will contain from about 1% to about 5% by weight of the $C_{14}$ alkyl sulfate as a detergency booster.

The surfactant used in the present invention can be either the purified $C_{10}$, $C_{11}$, $C_{12}$ and $C_{13}$ alkyl sulfates, or mixtures thereof. On a commercial scale, it is convenient and economical to fractionate alcohol feedstocks grossly into a light fraction which is substantially free from the $C_{15}$ and higher alcohols, but which can contain minor amounts of $C_9$, and lower alcohols. The major part of these light fractions consists essentially of the desired $C_{10}$–$C_{13}$ alcohols used to prepare the surfactant component herein. In contrast with the higher alkyl sulfates, the $C_9$ and lower compounds do not undesirably interact with the cellulose soil release ethers. Hence, the presence or absence of these lower alkyl sulfates in the present compositions is of no consequence. However, such lower materials are not particularly useful from the standpoint of detergency. In any event, when preparing the surfactant component for use herein on a commercial scale, it is simpler and more economical to sulfonate the total light fraction alcohols, rather than to separate the fraction into pure chain length cuts. Since the light fraction is substantially free from the undesirable higher alcohols, it is quite suitable for use herein. Accordingly, the surfactant component of the present invention can comprise mixtures of water-soluble $C_{10}$–$C_{13}$ alkyl sulfates.

Soil Release Ether Component

The soil release component herein comprises etherified cellulose. The basic structure of the cellulose ethers used in the present compositions can be depicted as follows, wherein n is an integer in the range of from about 100 to about 10,000, and wherein R′ represents alkyl, hydroxyalkyl, or mixed alkyl and hydroxyalkyl substituents, as described hereinafter. Useful alkyl groups include methyl, ethyl, propyl, butyl, pentyl, isobutyl, hexyl, nonyl, and the like. Preferred alkyl groups include methyl, ehtyl, propyl and butyl, with methyl being most preferred from the standpoint of cost, ease of manufacture and performance. Preferred hydroxyalkyl groups include hydroxymethyl, hydroxyethyl, hydroxypropyl and hydroxybutyl, with hydroxylbutyl being most preferred. Highly preferred, commercially available materials have R′ as mixtures of methyl and hydroxybutyl.

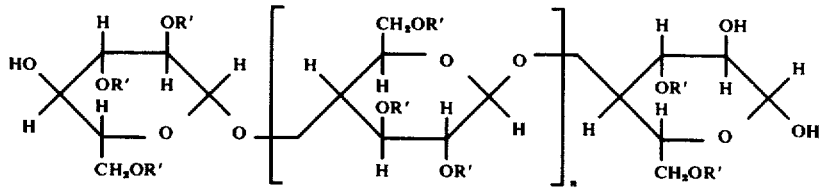

Processes for preparing the cellulose ethers are known and form no part of this invention. Briefly, when preparing the alkyl cellulose ether soil release agents employed in the present compositions, the hydroxyl groups of the anhydroglucose units of cellulose are reacted with an alkylating agent, thereby replacing the hydrogen of the hydroxyls with alkyl substituents. The number of substituent alkyl groups can be designated by weight percent, or by the average number of alkyl (i.e., as alkoxyl) groups on the anhydroglucose units, i.e., the Degree of Substitution (DS) alkyl. If all three available positions on each anhydroglucose unit are substituted, the DS alkyl is designated three (3); if an average of two -OH's are substituted, the DS alkyl is designated two (2), etc. Similar nomenclature is used to define the hydroxyalkyl and hydroxyalkyl alkyl cellulose ethers employed herein. When describing the hydroxyalkyl alkyl cellulosics, the degree of substitution of both substituent types is set forth.

Commercial processes for preparing alkyl cellulose ethers involve, for example, simply combining the desired alkyl halide, e.g., methyl chloride, with a cellulose feed stock of the type disclosed hereinafter under alkaline conditions. (It is to be understood that the alkyl halides used to prepare the cellulose soil release agents herein can contain minor amounts of alkyl halides other than that selected. The resulting cellulose ethers may contain very minor proportions of mixed alkyl groups. This is not important to the invention herein.) Such a process results in a DS alkyl below 2, and most generally a DS alkyl of about 1.5.

Higher DS alkyl cellulose ethers can be prepared by the exhaustive alkylation of cellulose using an alkyl halide, e.g., methyl chloride, and caustic, preferably sodium hydroxide, in a pressure vessel in the manner well known in the art for preparing the lower DS alkyl cellulosics. However, the alkylation procedure can simply be repeated and continued until the higher DS materials are secured. In either case, the progress of the alkylation reaction can be monitored by periodically sampling the reaction product and determining the degree of alkoxylation by various means well known in the art.

The exhaustive alkylation procedure herein results in the formation of cellulose ethers having a DS alkyl in the range of about 1.7 to about 3.0 (theoretical maximum). One class of highly preferred alkyl cellulose ethers herein has group R' as methyl and is characterized by a DS methyl in the range of about 2.0 to about 2.7.

The manufacture of the hydroxyalkyl alkyl cellulose soil release agents used herein is also carried out using well-known procedures. In a typical method, a cellulose feedstock is swelled with caustic soda solution to produce alkali cellulose, which is then treated with an alkyl halide (preferably methyl chloride) and an alkylene oxide (preferably butylene oxide). The DS alkyl and DS hydroxyalkyl of the resulting cellulose ether can be varied, depending on the reaction stoichiometry and reaction times and temperatures used, all in well-known fashion.

Similarly, hydroxyalkyl cellulose ethers can be prepared by reacting cellulose feedstocks with an alkylene oxide and caustic, usually at elevated temperatures and pressures, in the manner known in the art.

The cellulose feedstocks used to prepare the soil release ethers herein can be, for example, wood pulp or cotton linters. The harsh alkaline conditions of the etherification reaction commonly reduce the degree of polymerization (integer n in the foregoing formula) to 100–2000. This is of no substantil consequence to the present invention.

Representative, non-limiting examples of cellulose soil release agents used herein are as follows: methyl cellulose DS methyl 1.5; ethyl cellulose DS ethyl 1.2; methyl ether cellulose DS methyl 1.0, DS ethyl 0.7; hydroxyethyl cellulose DS hydroxyethyl 1.2; hydroxypropyl cellulose DS hydroxypropyl 1.5; methyl hydroxyethyl cellulose DS methyl 1.5, DS hydroxyethyl 0.1; methyl hydroxyethyl cellulose DS methyl 1.5, DS hydroxyethyl 0.5; and butyl cellulose DS butyl 1.5.

The cellulose ethers employed herein are water-soluble and are characterized by a negative temperature coefficient of solubility. Being polymeric, and having the potential for inter-molecular association by virtue of their side-chain substituents, the cellulose ethers herein increase the viscosity of aqueous solutions, especially when present therein in concentrations of about 2%. The solution viscosity of the cellulose ethers is unimportant when preparing granular detergent compositions, inasmuch as they are ultimately present in the aqueous laundry bath in such small concentrations. However, when preparing liquid detergent compositions in the manner of the present invention the solution concentration of the soil release ether is high enough that viscosity can be a problem. For example, it is desirable to provide liquid detergent compositions which are readily pourable and measurable, and which are not of a gelatinous or syrupy consistency. When preparing such liquid detergent compositions, it is preferred to select a cellulose ether of the foregoing type having a solution viscosity below about 250 centipoise (cps). Preferably, the solution viscosity of the cellulose ethers employed in the liquid detergent compositions prepared according to the present invention lies in the range from about 20 cps to about 200 cps (measured as a 2% wt. aqueous solution at 32° C).

It is to be understood that by selecting the narrow cut of surfactants as disclosed herein the soil release efficacy of detergent compositions containing substantially all soil release ethers of the type disclosed above is optimized in the general manner disclosed in the FIGURE. That is to say, the select surfactants employed herein interfere much less with the inherent soil release properties of the cellulose ethers (as measured by deposition on fabrics from pure distilled water) than do other members of the surfactant class falling outside the recited range. However, this is not to say that all soil release ethers are equivalent in their soil release performance on fabrics, especially polyester and polyester/cotton blends. Certain cellulose ethers inherently provide less of a soil release benefit than do others, even when applied to fabrics from distilled water in the absence of interfering surfactants. For example, certain hydroxypropyl cellulosics are inherently poorer in their soil release performance, even when applied to fabrics from an aqueous medium in the absence of any surfactants, than the methyl hydroxybutyl cellulosics applied in similar fashion. This difference in performance naturally carries over to compositions containing the surfactants disclosed herein. Accordingly, to provide optimal soil release performance it is preferred to choose certain of the herein-disclosed soil release ethers for use in combination with the disclosed select group of surfactants.

Moreover, it has now been found that, while the soil release performance of any of the cellulosics is better when used in combination with the preferred surfactants disclosed herein than with those falling outside the class, performance is detrimentally affected by fabric finishes. However, it has been discovered that certain cellulosics function well, even on finished polyester/cotton fabrics. Accordingly, it is now possible to describe highly preferred, robust cellulose ethers which are suitable for use in combination with the select group of surfactants to impart soil release properties to both polyester and finished and unfinished blend fabrics.

Preferred alkyl cellulose ethers herein are the $C_1$ to $C_4$ alkyl ethers, especially methyl, having a DS alkyl of from about 1.2 to about 2.9. Alkyl ethers having a DS alkyl of from about 1.3 to about 2.0 are commercially available and are especially useful members of this class of soil release ethers.

Preferred hydroxyalkyl cellulose ethers herein are the hydroxyethyl, hydroxypropyl and hydroxybutyl cellulosics having a DS hydroxyalkyl of from about 1.2 to about 2.9, more preferably about 1.3 to about 1.7. As a class, the hydroxyalkyl cellulosics are somewhat lower in soil release performance than the alkyl or mixed hydroxyalkyl alkyl cellulosics. Nevertheless, these materials are useful herein and offer the advantage of somewhat higher water solubility than the other classes of cellulosics, with attendant advantages in liquid formulations.

The hydroxyalkyl alkyl cellulosics, especially those having a DS hydroxyalkyl of at least about 0.01 and a DS alkyl of at least about 1.0, preferably a DS alkyl from about 1.3 to about 2.5, form an especially preferred class of soil release ethers herein from the standpoint of their inherently good soil release performance. Many such materials are commercially available.

Preferred hydroxyalkyl alkyl cellulosics are those wherein the DS hydroxyalkyl is at least about 0.05, the DS alkyl is at least about 1.0 and the total DS (alkyl + hydroxyalkyl) is at least about 1.05, more preferably at least about 1.5. Hydroxyalkyl alkyl cellulosics wherein the alkyl group is $C_1$–$C_4$, especially methyl, and wherein the hydroxyalkyl group is hydroxyethyl, hydroxypropyl or hydroxybutyl, are especially preferred.

When preparing robust detergent compositions suitable for use on either finished or unfinished fabrics, especially polyester/cottons, it is preferable to select a cellulose ether from either the alkyl or hydroxyalkyl alkyl classes set forth above. The most robust alkyl cellulsoe ethers are those having a relatively high DS alkyl, in the range of about 1.7 to about 2.7. These high DS alkyl cellulosics are readily prepared by the exhaustive alkylation procedure set forth above. Methyl cellulose ethers characterized by a DS methyl in the range of 1.8 to 2.2 are readily available and especially preferred in the present compositions.

Robust hydroxyalkyl alkyl cellulosics also fall within the more highly substituted members of this class, especially with regard to their DS alkyl. Preferred among this class are those cellulosics having a DS alkyl in the range of about 1.7 to 2.7, especially 1.8 to 2.2, with methyl being the preferred alkyl substituent. The DS hydroxyalkyl in this preferred class of cellulosics is less critical than the DS alkyl, and falls within a range of about 0.01 to 1.0, most preferably about 0.06 to 1.0. Hydroxybutyl is the most preferred hydroxyalkyl substituent.

Especially preferred herein is methyl hydroxybutyl cellulose, DS methyl avg. 1.8–2.2, DS hydroxybutyl avg. 0.08, available under the tradename Methocel HB. Other preferred ethers include ethyl hydroxyethyl cellulose DS ethyl 1.7, DS hydroxyethyl 0.9; and methyl hydroxyethyl cellulose DS methyl 1.7, DS hydroxyethyl 0.09.

As disclosed hereinabove the solution vicosity of the cellulose ethers is not critical to their performance. However, this parameter, used in combination with the DS alkyl and DS hydroxyalkyl, does help further specify the highly preferred, robust cellulosics herein. The solution viscosity (2% aqueous) of these cellulosics lies in the wide range of about 100 cps to 25000 cps, more particularly 400 cps to 15000 cps.

It is to be understood that the common anionically substituted cellulosics, e.g., carboxymethyl cellulose, do not fall within the definition of cellulose ethers herein. Such anionic cellulosics are not contemplated for use as the soil release ether component herein, but can be present in minor quantities in the instant compositions for their known performance benefits as soil suspending agents, carriers, thickeners, and the like.

Detergency Builders and Adjuncts

The instant compositions can optionally contain all manner of detergency builders commonly taught for use in detergent compositions. The detergent compositions herein can contain from about 0% to about 70% by weight, preferably from about 25% to about 65% by weight, more preferably from about 15% to about 65% by weight, of said builders. Useful builders herein include any of the conventional inorganic and organic water-soluble builder salts, as well as various water-insoluble and so-called "seeded" builders.

Inorganic detergency builders useful herein include, for example, water-soluble salts of phosphates, pyrophosphates, orthophosphates, polyphosphates, phosphonates, carbonates, polyhydroxysulfonates, silicates, polyacetates, carboxylates, polycarboxylates and succinates. Specific examples of inorganic phosphate builders include sodium and potassium tripolyphosphates, phosphates, and hexametaphosphates. The polyphosphonates specificaly include, for example, the sodium and potassium salts of ethylene diphosphonic acid, the sodium and potassium salts of ethane 1-hydroxy-1, 1-diphosphonic acid and the sodium and potassium salts of ethane-1,1,2-triphosphonic acid. Examples of these and other phosphorus builder compounds are disclosed in U.S. Pat. Nos. 3,159,581; 3,213,030; 3,422,021; 3,422,137; 3,400,176 and 3,400,148, incorporated herein by reference. Sodium tripolyphosphate is an especially preferred, water-soluble inorganic builder herein.

Non-phosphorus containing sequestrants can also be selected for use herein as detergency builder.

Specific examples of non-phosphorus, inorganic builder ingredients include water-soluble inorganic carbonate, bicarbonate, and silicate salts. The alkali metal, e.g., sodium and potassium, carbonates, bicarbonates, and silicates are particularly useful herein.

Water-soluble, organic builders are also useful herein. For example, the alkali metal, ammonium and substituted ammonium polyacetates, carboxylates, polycarboxylates and polyhydroxysulfonates are useful builders in the present compositions and processes. Specific examples of the polyacetate and polycarboxylate builder salts include sodium, potassium, lithium, ammonium and substituted ammonium salts of ethylenediaminetetraacetic acid, nitrilotriacetic acid, oxydisuccinic acid, mellitic acid, benzene polycarboxylic acids, and citric acid.

Highly preferred non-phosphorus builder materials (both organic and inorganic) herein include sodium carbonate, sodium bicarbonate, sodium silicate, sodium citrate, sodium oxydisuccinate, sodium mellitate, sodium nitrilotriacetate, and sodium ethylenediaminetetraacetate, and mixtures thereof.

Other highly preferred organic builders herein are the polycarboxylate builders set forth in U.S. Pat. No. 3,308,067, Diehl, incorporated herein by reference. Examples of such materials include the water-soluble salts of homo- and co-polymers of aliphatic carboxylic acids such a maleic acid, itaconic acid, mesaconic acid, fumaric acid, aconitic acid, citraconic acid and methylenemalonic acid.

Additional, preferred builders herein include the water-soluble salts, especially the sodium and potassium salts, of carboxymethyloxymalonate, carboxymethyloxysuccinate, cis-cyclohexanehexacarboxylate, cis-cyclopentanetetracarboxylate and phloroglucinol, trisulfonate.

Sodium nitrilotriacetate is an especially preferred, water-soluble organic builder herein.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are fully disclosed in the co-pending application of Benjamin, Ser. No. 248,546, filed Apr. 28, 1972 now abandoned, the disclosures of which are incorporated herein by reference.

More particularly, the seeded builders useful herein comprise a crystallization seed having a maximum particle dimension of less than 20 microns, preferably a particle diameter of from about 0.01 micron to about 5 microns, in combination with a material capable of forming a water-insoluble reaction product with free metal ions.

Many builder materials, e.g., the water-soluble carbonate salts, precipitate water hardness cations, thereby performing a builder function. Unfortunately, many of the precipitating builders used in detergent compositions do not reduce the free metal ion content of laundry baths quickly, and such builders only compete with the organic detergent and the soil for the free metal ions. The result is that while some of the free metal ions are removed from the solution, some ions do react with the organic detergent and the soil, thereby decreasing the detersive action. The use of the crystallization seed quickens the rate of precipitation of the metal hardness, thereby removing the hardness ions before they can adversely affect the detergency performance.

By using a material capable of forming a water-insoluble product with free metal ions in combination with a crystallization seed, the combined free metal ion concentration of an aqueous laundering liquor can be reduced to less than 0.5 grains of hardness within about 120 seconds. In fact, the preferred seeded builders can reduce the free metal hardness to less than 0.1 grains/-gallon within about 30 seconds.

Preferred seeded builders consist of: a water-soluble material capable of forming a reaction product having a solubility in water of less than about $1.4 \times 10^{-2}$ wt. % (at 25° C) with divalent and polyvalent metal ions such as calcium, magnesium and iron; and a crystallization seed (0.001–20 micron diameter) which comprises a material which will not completely dissolve in water within 120 seconds at 25° C.

Specific examples of materials capable of forming the water-insoluble reaction product include the water-soluble salts of carbonates, bicarbonates, sesquicarbonates, silicates, aluminates and oxalates. The alkali metal, especially sodium, salts of the foregoing materials are preferred for convenience and economy.

The crystallization seed employed in such seeded builders is preferably selected from the group consisting of calcium carbonate; calcium and magnesium oxalates; barium sulfate; calcium, magnesium and aluminum silicates; calcium and magnesium oxides; calcium and magnesium salts of fatty acids having 12 to 22 carbon atoms; calcium and magnesium hydroxides; calcium fluoride; and barium carbonate. Specific examples of such seeded builder mixtures comprise: 3:1 wt. mixtures of sodium carbonate and calcium carbonate having a 5 micron particle diameter; 2.7:1 wt. mixtures of sodium sesquicarbonate and calcium carbonate having a particle diameter of 0.5 microns; 20:1 wt. mixtures of sodium sesquicarbonate and calcium hydroxide having a particle diameter of 0.01 micron; and a 3:3:1 wt. mixture of sodium carbonate, sodium aluminate and calcium oxide having a particle diameter of 5 microns.

A seeded builder comprising a mixture of sodium carbonate and calcium carbonate is especially preferred herein. A highly preferred seeded builder comprises a 30:1 to 5:1 (wt. $Na_2CO_3$:$CaCO_3$) mixture of sodium carbonate and calcium carbonate wherein the calcium carbonate has an average particle diameter from 0.01 micron to 5 microns.

Another type of builder useful herein includes various substantially water-insoluble materials which are capable of reducing the hardness content of laundering liquors, e.g., by ion-exchange processes. Examples of such builder materials include the phosphorylated cloths disclosed in U.S. Pat. No. 3,424,545, to R. A. Bauman, issued Jan. 28, 1969, incorporated herein by reference.

As noted above, the avoidance of electrolytes (e.g., water-soluble builder salts) has an additional positive effect on the soil release performance of the cellulose ether/surfactant compositions herein. Therefore, it is particularly advantageous to provide compositions comprising the preferred surfactants, cellulose ether, and a non-electrolyte (i.e., water-insoluble) builder material.

The complex aluminosilicates, i.e., zeolite-type materials, are especially useful builders in the present compositions, since these materials are water-insoluble and readily soften water, i.e., remove $Ca^{++}$ hardness. Both the naturally occurring and synthetic "zeolites," especially the zeolite A and hydrated zeolite A materials, are useful for this builder/softener purpose, and do not interfere with cellulose ethers. A description of zeolite A materials and a method of preparation appears in U.S. Pat. No. 2,882,243, entitled MOLECULAR SIEVE ADSORBENTS issued Apr. 14, 1959, incorporated herein by reference.

The compositions herein can contain all manner of detergent adjunct materials and carries commonly found in laundering and cleaning compositions. For example, various perfumes, optical bleaches, fillers, anti-caking agents, fabric softeners and the like can be present to provide the usual benefits occasioned by the use of such materials in detergent compositions.

Perborate bleaches commonly employed in European detergent compositions can also be present as a component of the instant detergent compositions, and are added thereto as dry admixes.

Enzymes, especially the thermally stable proteolytic and lipolytic enzymes used in laundry detergents, can be dry-mixed in the compositions herein.

Materials such as sodium sulfate can be used as fillers for the granular compositions herein. Water and water-alcohol mixtures (especially 20:1 to 10:1 wt. water/ethanol mixtures) are useful carriers for liquid compositions comprising the surfactant and soil release ethers disclosed herein.

Product Testing

The soil release efficacy of the compositions herein is tested using a typical, hard to remove, greasy soil, dirty motor oil. The Dirty Motor Oil (DMO) removal test, as used in the FIGURE herein, is carried out in the following general manner. Fabric swatches (polyester or polyester/cotton) are laundered in an aqueous bath containing detersive levels (200 ppm) of the chosen alkyl benzene sulfonate cut, in combination with a "typical" builder-electrolyte mix (600 ppm sodium tripolyphosphate, 250 ppm sodium sulfate, 70 ppm sodium silicate) and a cellulose ether, at varying concentrations (Methocel HB 15000 was used in the Figure). Following the laundering/soil release ether treatment, the swatches are spotted with known amounts of dirty motor oil and re-laundered in a commercial, phosphate built detergent (0.12% in the bath) and the soil release ether (12 ppm in the bath). Soil release can be determined visually, but is preferably compared gravimetrically with control swatches (no soil release polymer treatment). The curves in FIG. 1 relate to oil removal perforance on polyester/cotton.

The DMO test carried out in the presence of surfactant, builder and electrolyte is representative of in-use home laundry conditions involving fabrics heavily soiled with greasy stains.

The following examples are typical of the detergent compositions of this invention, but are not intended to be limiting thereof. The granular compositions are conveniently prepared by combining all components except the cellulose ether in an aqueous crutcher slurry and spray-drying the slurry in standard fashion to provide homogeneous granules. The cellulose ether is then added to the granules as a dry admix. The liquid compositions are prepared by mixing the components in a liquid carrier, which is typically 50% to 90% by weight of the total composition of water or water-alcohol (e.g., methanol, ethanol, isopropanol) mixtures. Preferred liquid carriers are water and 100:1 to 10:1 (wt.) mixtures of water/ethanol.

The granular compositions herein are typically used at 1 cup to 1.5 cup levels in a laundry bath of 15–20 gallons (ca. 0.12% concentration). The liquid compositions are typically used at 0.25 to 0.5 cup levels. Typical concentrations of surfactant in the laundry bath are ca. 200 ppm; builder concentration is ca. 600–800 ppm; soil release ether concentration is ca. 12 ppm-50 ppm. More or less of the compositions can be employed, according to the desires of the user, depending on fabric and soil loads.

EXAMPLE I

A phosphate-built granular detergent composition is as follows:

| Ingredient | % (wt.) |
|---|---|
| Sodium n-dodecyl sulfate | 25.0 |
| Methocel HB 15000* | 1.5 |
| Sodium tripolyphosphate | 33.0 |
| Sodium silicate | 7.0 |
| Sodium sulfate | 30.0 |
| Minors (perfume, optical brighteners, water, etc.) | |

*Methyl hydroxybutyl cellulose; DS methyl ca. 2; DS hydroxybutyl ca. 0.08; 2% solution viscosity 15000 centipoise; available from Dow Chemical Co.

The composition of Example I is used at a concentration of 0.12% (wt.) in an aqueous laundry bath to launder dirty fabrics in a home automatic washing machine using the manufacture's instructions. The fabrics are concurrently cleansed and provided with an oily soil release finish.

The composition of Example I is modified by the addition of 1% (wt.) of sodium n-tetradecyl sulfate as a detergency booster and excellent fabric cleansing is secured together with the deposition of a soil release finish on the fabrics.

EXAMPLE II

A highly built granular detergent containing a proteolytic enzyme especially adapted to use under European laundering conditions is as follows:

| Ingredient | % (wt.) |
|---|---|
| Mixed $C_{11}$—$C_{12}$ linear alkyl sulfate, sodium salt* | 23.0 |
| Sodium tripolyphosphate | 65.0 |
| Methocel HB 15000 | 1.0 |
| Soluble sodium silicate | 5.0 |
| Proteolytic enzyme** | 1.0 |
| Water and minors | |

*Containing ca. 4% $C_{12}$ and $C_{14}$ linear alkyl sulfates and substantially free from $C_{16}$ and higher alkyl sulfates.
**Proteolytic enzyme from Thermoactinomyces Vulgaris ATCC15734.

The composition of Example II is prepared by spray-drying all ingredients except the enzyme and the Methocel HB 15000 to form homogeneous granules. The enzyme and Methocel HB 15000 are thereafter added to the granules as a dry admix.

The composition of Example II is used at a concentration of 0.24% (wt.) in a front loading automatic washer, avg. water temperature 90° C, to launder a mixed load of finished and unfinished polyester and polyester/cotton fabrics. The fabrics are provided with a uniform soil release finish.

In the composition of Example II the Methocel HB 15000 is replaced by an equivalent amount of methyl cellulose, avg. DS methyl 2.0; methyl hydroxyethyl cellulose, DS methyl 2.0, DS hydroxyethyl 0.2; and methyl ethyl cellulose, DS methyl 1.0, DS ethyl 0.5; respectively, and excellent soil release finishes are secured.

EXAMPLE III

A non-phosphorus built granular detergent is as follows:

| Ingredient | % (wt.) |
|---|---|
| Nitrilotriacetate, trisodium salt | 25.0 |
| $C_{12}$ linear alkyl sulfate, Na salt | 20.0 |

-continued

| Ingredient | % (wt.) |
|---|---|
| $C_{14}$ linear alkyl sulfate, Na salt | 2.0 |
| Methocel HB 15000 | 1.5 |
| Sodium sulfate | 48.0 |
| Water and minors | |

The composition of Example III is used in the same manner as the composition of Example I to cleanse fabrics and to provide a soil release finish thereon.

In the composition of Example III, the nitrilotriacetate is replaced by an equivalent amount of a builder comprising hydrated zeolite A particles (ca. 1 micron diameter) and equivalent results are secured.

In the composition of Example III, the nitrilotriacetate builder is replaced by an equivalent amount of a builder consisting of a 15:1 (wt.) mixture of sodium carbonate and calcium carbonate particles (particle size avg. 1.0 micron) and equivalent results are secured.

EXAMPLE IV

A liquid detergent is as follows:

| Ingredient | % (wt.) |
|---|---|
| Mixed $C_{10}$—$C_{13}$ alkyl sulfates*, triethanolammonium salt | 20.0 |
| Cellulose ether** | 2.0 |
| Triethanolamine | 3.0 |
| Water-ethanol (95:5 wt.) | 74.0 |
| Perfume, dye, minors | Balance |

*Substantially free of $C_{15}$ and higher sulfates; ca. 2% $C_{14}$ sulfates present.
**Methyl (DS 1.7) hydroxybutyl (DS 0.1) cellulose; viscosity of 2% aqueous solution 200 cps.

The composition of Example IV is used at a concentration of 0.1% (wt.) in an aqueous bath to launder finished polyester fabrics. The fabrics are cleansed and provided with a soil release finish of the cellulose ether.

What is claimed is:

1. A detergent composition comprising:
   a. from about 5% to about 50% by weight of surfactant component consisting essentially of a water-soluble alkyl sulfate wherein the alkyl substituent has a chain length in the rangee of $C_{10}$–$C_{13}$, or mixtures thereof, said surfactant component containing less than about 5% by weight of $C_{15}$ and higher alkyl sulfates;
   b. from about 1% to about 5% by weight of a water-soluble alkyl sulfate wherein the alkyl substituent is $C_{14}$;
   c. from about 0.1% to about 3% by weight of a soil release ether component selected from the group consisting of alkyl cellulose ethers, hydroxyalkyl cellulose ethers and hydroxyalkyl alkyl cellulose ethers;
   d. from about 0% to about 70% by weight of a detergency builder component; and
   e. the balance of the composition comprising detergency adjunct materials and carriers selected from the group consisting of perfumes, optical bleaches, fillers, anti-caking agents, fabric softeners, perborate bleaches, enzymes, water, water-alcohol mixtures and mixtures thereof.

2. A composition according to claim 1 characterized by a weight ratio of surfactant component:soil release ether component in the range of from about 5:1 to about 100:1.

3. A composition according to claim 2 wherein the surfactant component is selected from the group consisting of the alkyl metal, ammonium and alkanolammonium salts of $C_{10}$–$C_{13}$ alkyl sulfates, and mixtures thereof.

4. A composition according to claim 3 wherein the surfactant component is in the sodium salt form.

5. A composition according to claim 2 wherein the soil release ether component is an alkyl cellulose ether having a DS alkyl of from about 1.7 to about 3.0.

6. A composition according to claim 2 wherein the alkyl cellulose ether is selected from the group consisting of methyl, ethyl, propyl and butyl cellulose ethers having a DS alkyl of from about 1.2 to about 2.9.

7. A composition according to claim 6 wherein the alkyl cellulose ether is a methyl cellulose ether characterized by a DS methyl in the range from about 2.0 to about 2.7.

8. A composition according to claim 2 wherein the soil release ether component is a hydroxyalkyl cellulose ether having a DS hydroxyalkyl of from about 1.2 to about 2.9.

9. A composition according to claim 8 wherein the hydroxyalkyl cellulose ether is selected from the group consisting of hydroxyethyl, hydroxypropyl and hydroxybutyl cellulose ethers having a DS hydroxyalkyl of from about 1.3 to about 1.7.

10. A composition according to claim 2 wherein the soil release ether component is a hydroxyalkyl alkyl cellulose ether having a DS hydroxyalkyl of at least about 0.01 and a DS alkyl of at least about 1.0.

11. A composition according to claim 10 wherein the hydroxyalkyl substituent in the hydroxyalkyl alkyl cellulose ether is independently selected from the group consisting of hydroxyethyl, hydroxypropyl and hydroxybutyl wherein the DS hydroxyalkyl is at least about 0.05 and wherein the alkyl substituent is independently selected from methyl, ethyl, propyl and butyl wherein the DS alkyl is at least about 1.0.

12. A composition according to claim 10 wherein the hydroxyalkyl alkyl cellulose ether is characterized by a DS alkyl in the range of from about 1.7 to about 2.7 and a DS hydroxyalkyl in the range of from about 0.01 to about 1.0.

13. A composition according to claim 12 wherein the DS alkyl of the cellulose ether is from about 1.8 to about 2.2 and the DS hydroxyalkyl is from about 0.06 to about 1.0.

14. A granular detergent composition according to claim 2 comprising from about 15% to about 65% by weight of a water-soluble detergency builder.

15. A composition according to claim 14 wherein the builder is an inorganic detergency builder.

16. A composition according to claim 15 wherein the inorganic builder is sodium tripolyphosphate.

17. A composition according to claim 16 wherein the builder is an organic detergency builder.

18. A composition according to claim 17 wherein the organic builder is sodium nitrilotriacetate.

19. A composition according to claim 2 wherein the detergency builder is a seeded builder.

20. A composition according to claim 19 wherein the seeded builder comprises a 30:1 to 5:1 weight mixture of sodium carbonate and particulate calcium carbonate having an average particle diameter from 0.01 microns to 5 microns.

21. A composition according to claim 2 wherein the detergency builder is substantially water-insoluble.

22. A composition according to claim 21 wherein the detergency builder is a zeolite-type material.

23. A composition according to claim 2, said composition comprising from about 0.5% to about 1.5% by weight of the soil release ether component.

24. A composition according to claim 5 wherein the DS alkyl is from about 1.7 to about 2.7.

25. A composition according to claim 24 wherein the alkyl cellulose ether is a methyl cellulose ether characterized by a DS methyl in a range from about 1.8 to about 2.2.

26. A composition according to claim 13 wherein the hydroxyalkyl alkyl cellulose ether is a methyl hydroxybutyl cellulose characterized by a DS methyl in a range from about 1.8 to about 2.2 and a DS hydroxybutyl of about 0.08.

* * * * *